US005488986A

United States Patent [19]

Poran et al.

[11] Patent Number: 5,488,986

[45] Date of Patent: Feb. 6, 1996

[54] MOLD OSCILLATOR FOR CONTINUOUS CASTING APPARATUS

[75] Inventors: Michael A. Poran, Westwood; Sol Fenick, Fair Lawn, both of N.J.

[73] Assignee: SMS Concast Inc., Montvale, N.J.

[21] Appl. No.: 278,062

[22] Filed: Jul. 20, 1994

[51] Int. Cl.[6] ..... B22D 11/04

[52] U.S. Cl. ..... 164/416; 164/478

[58] Field of Search ..... 164/416, 478

[56] References Cited

U.S. PATENT DOCUMENTS

| | | | |
|---|---|---|---|
| 1,385,595 | 7/1921 | VanRanst | 164/416 X |
| 3,523,571 | 8/1970 | Niskovskish et al. | 164/416 |
| 3,703,923 | 11/1972 | Teplitz | 164/416 X |

FOREIGN PATENT DOCUMENTS

| | | | |
|---|---|---|---|
| 4127331 | 2/1993 | Germany | 164/416 |
| 59-87960 | 5/1984 | Japan | 164/416 |
| 60-44154 | 3/1985 | Japan | 164/416 |

*Primary Examiner*—J. Reed Batten, Jr.
*Attorney, Agent, or Firm*—Darby & Darby

[57] ABSTRACT

An oscillator for oscillating a mold in a continuous casting apparatus has a motor, and a linkage connecting the motor to the mold. The linkage includes a pair of noncircular gears which are in mesh with one another. The noncircular gears are arranged and designed such that, during the major part of the displacement of the mold concurrently with a strand being cast in the mold, the speed of the mold exceeds the casting speed.

7 Claims, 1 Drawing Sheet

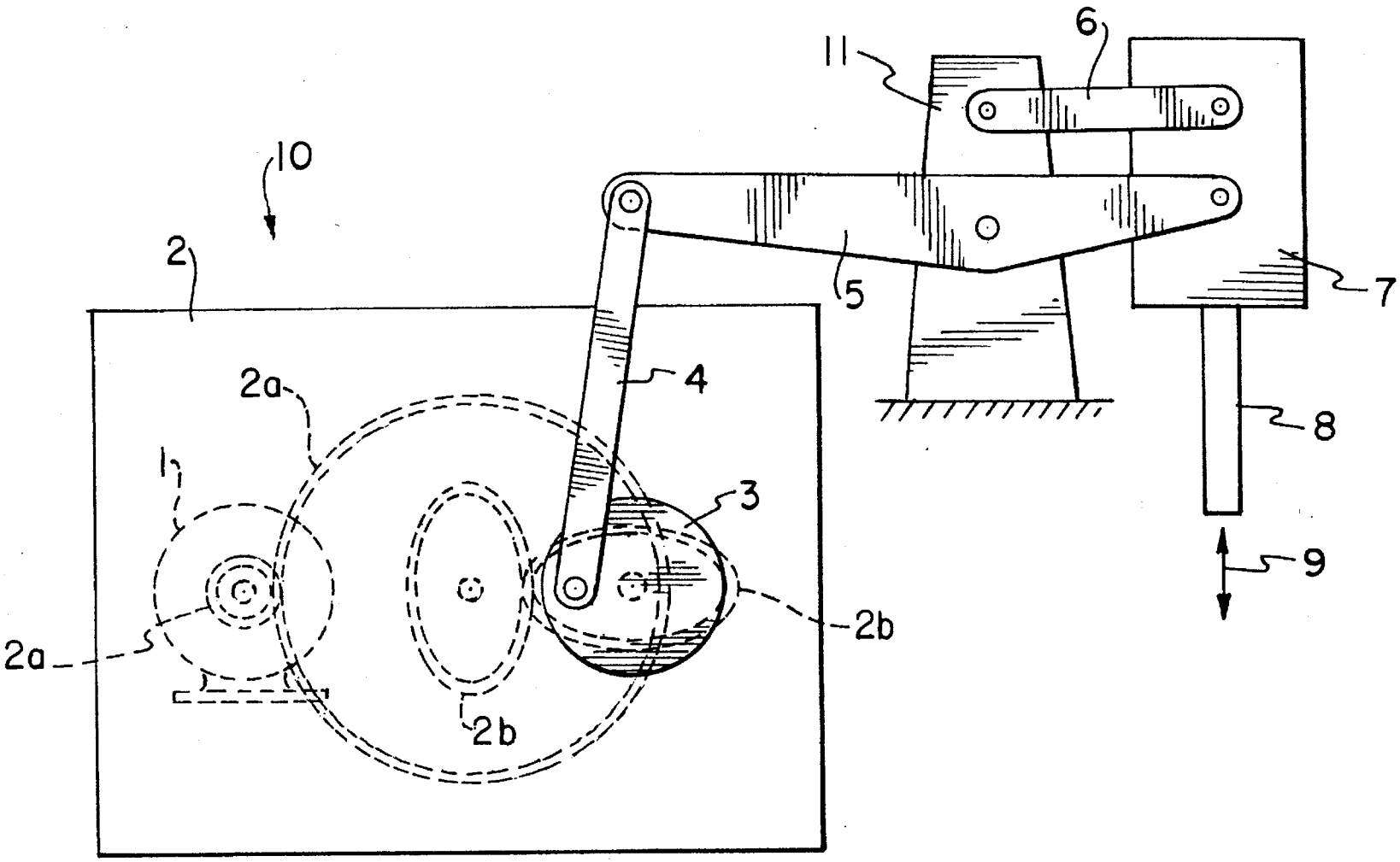
7
8
9
6
11
5
2b
3
4
2b
10
2a
2
1
2a

MOLD OSCILLATOR FOR CONTINUOUS CASTING APPARATUS

FIELD OF THE INVENTION

The invention relates to continuous casting.

BACKGROUND OF THE INVENTION

The strand formed during continuous casting has a tendency to stick to the mold. In order to avoid this, the mold is oscillated.

Various types of oscillators are in use. The simplest and most versatile is the so-called "short lever oscillator". With this oscillator, the speed of the mold varies sinusoidally. The sinusoidal speed variation presents a problem during the stroke in which the mold travels concurrently with the strand. Thus, the process of stripping the strand from the mold takes place only during the minor portion of this stroke in which the speed of the mold is greater than the casting speed, i.e., the speed of the strand.

The four eccentric oscillator produces a motion similar to that of the short lever oscillator and leads to the same problem.

Many attempts have been made to develop an oscillatory movement with a better stripping action. One result of these attempts is the cam follower oscillator which causes the mold to move at a relatively constant speed in excess of the casting speed during the major portion of the stroke in which the mold travels concurrently with the strand. However, the cam follower oscillator is extremely complex, requires a large amount of maintenance and is very sensitive to contamination and wear.

The hydraulically driven oscillator is likewise capable of moving the mold in excess of the casting speed during the major portion of the stroke in which the mold travels concurrently with the strand. This oscillator again requires considerable maintenance. Moreover, the controls are complex and subject to wear.

SUMMARY OF THE INVENTION

It is an object of the invention to provide an arrangement which can be constructed relatively simply yet enables the mold to be moved in excess of the casting speed during the major portion of the stroke in which the mold travels concurrently with the strand.

Another object of the invention is to provide an arrangement which allows maintenance to be reduced but nevertheless permits the mold to be moved in excess of the casting speed during the major portion of the stroke in which the mold travels concurrently with the strand.

An additional object of the invention is to provide an arrangement which enables wear to be decreased yet is capable of moving the mold in excess of the casting speed during the major portion of the stroke in which the mold travels concurrently with the strand.

A further object of the invention is to provide an arrangement which can be made relatively insensitive to contamination but is still able to move the mold in excess of the casting speed during the major portion of the stroke in which the mold travels concurrently with the strand.

It is also an object of the invention to provide an arrangement which can be constructed relatively inexpensively yet allows the mold to be moved in excess of the casting speed during the major portion of the stroke in which the mold travels concurrently with the strand.

Still another object of the invention is to provide a method which makes it possible to move the mold in excess of the casting speed relatively easily during the major portion of the stroke in which the mold travels concurrently with the strand.

One more object of the invention is to provide a method which can be performed relatively inexpensively yet is capable of causing the mold to move in excess of the casting speed during the major portion of the stroke in which the mold travels concurrently with the strand.

The preceding objects, as well as others which will become apparent as the description proceeds, are achieved by the invention.

One aspect of the invention resides in an arrangement for oscillating a mold back-and-forth along a predetermined direction during continuous casting of a strand which is formed in the mold and is withdrawn from the latter in the predetermined direction at a predetermined speed. The arrangement comprises drive means, and means for linking the drive means to the mold. The linking means includes noncircular gear means for moving the mold in excess of the predetermined speed during the major part of the displacement of the mold concurrently with the strand.

In accordance with the invention, the mold is driven by noncircular gear means. Similarly to the cam follower and hydraulic oscillators, this type of gear means is capable of producing an oscillatory motion in which the speed of the mold exceeds the casting speed during the major part of a stroke. However, in contrast to the conventional cam follower and hydraulic oscillators, an arrangement with noncircular gear means can be relatively simple and economical and can be constructed so as to require relatively little maintenance and have good resistance to wear and contamination.

BRIEF DESCRIPTION OF THE DRAWING

Additional features and advantages of the invention will be forthcoming from the following detailed description of certain preferred embodiments when read in conjunction with the accompanying drawing.

The sole figure schematically illustrates a continuous casting apparatus with an oscillator according to the invention.

DESCRIPTION OF PREFERRED EMBODIMENTS

The FIGURE shows a continuous casting apparatus of the type commonly used to cast steel, for example. The apparatus includes a mold 7 which, in operation, converts molten material into a strand 8. The strand 8 is continuously withdrawn from the mold 7 by a non-illustrated withdrawal unit which conveys the strand 8 in a direction 9 at a predetermined speed referred to as the casting speed.

The strand 8 tends to stick to the mold 7 and, in order to prevent this, the mold 7 is oscillated back-and-forth along the direction 9 so that the mold 7 alternately moves concurrently with and counter to the strand 8. The oscillatory movement of the mold 7 is intended to strip the strand 8 from the mold 7. This action always takes place satisfactorily when the mold 7 travels counter to the strand 8. However, when the mold 7 travels concurrently with the strand 8, a good stripping action is obtained only when the speed of the mold 7 exceeds the casting speed. If the motion of the mold 7 is sinusoidal as with a conventional short lever oscillator, a good stripping action is obtained during only a minor part of the displacement of the mold 7 concurrently with the strand 8.

The mold 7 in the FIGURE is oscillated by a short lever oscillator 10 which has been modified in accordance with the invention so as to improve the stripping action. Thus, the oscillator 10 oscillates the mold 7 in such a manner that the speed of the mold 7 exceeds the casting speed during the major part of the displacement of the mold 7 concurrently with the strand 8.

The oscillator 10 comprises an electrical motor or drive means 1 having a drive shaft which is connected to a gear reducer 2. The gear reducer 2 is provided with a pair of circular gears 2*a*, and the gears 2*a* include a smaller gear mounted on the drive shaft of the motor 1 and a larger gear in mesh with the smaller gear. The larger gear has an output shaft which, in a conventional short lever oscillator, supports an eccentric 3. A connecting rod 4 is mounted on the eccentric 3 and connects the latter to a main arm 5. The main arm 5 is pivoted intermediate its ends on a support 11 and constitutes a two-armed lever. One arm of the lever 5 is articulated to the rod 4 while the other arm of the lever 5 is connected to the mold 7. A guide arm 6 pivotally mounted on the support 11 and connected to the mold 7 helps to confine the mold 7 to travel along the direction 9.

In the oscillator 10, the output shaft of the larger of the circular gears 2*a* is not directly connected to the eccentric 3. Instead, the output shaft of the larger circular gear is connected to the eccentric 3 via a pair of noncircular gears 2*b*, e.g., elliptical gears. One of the noncircular gears 2*b* is mounted on the output shaft of the larger circular gear. The other noncircular gear meshes with the first noncircular gear and is provided with an output shaft which carries the eccentric 3.

The noncircular gears 2*b* are arranged and designed in such a manner that the speed of the mold 7 exceeds the casting speed during the major part of the displacement of the mold 7 concurrently with the strand 8. In contrast to the prior art short lever oscillator where the speed of the mold exceeds the casting speed, and a good stripping action occurs, only during a minor part of the displacement of the mold concurrently with the strand, the noncircular gears 2*b* allow a good stripping action to take place during most of the displacement of the mold 7 concurrently with the strand 8.

It is preferred for the noncircular gears 2*b* to be arranged and designed so that the speed of the mold 7 remains relatively constant over the major part of the displacement of the mold 7 concurrently with the strand 8. Furthermore, the noncircular gears 2*b* can be arranged and designed in such a fashion that the mold 7 has a regular periodic velocity profile, i.e., a profile such that the speed of the mold 7 varies in the same manner during travel concurrently with and counter to the strand 8.

In addition to providing an improved stripping action, the oscillator 10 exhibits all of the advantages which have made the short lever oscillator widely used in the art. Thus, the oscillator 10 is simple, reliable and economical. Moreover, the oscillator 10 is not subject to high rates of wear and is relatively insensitive to contamination. The oscillator 10 also requires relatively little maintenance.

The oscillator 10 is highly versatile in that it can be installed in new continuous casting apparatus and readily retrofitted on existing continuous casting apparatus.

Various modifications are possible within the meaning and range of equivalence of the appended claims. For example, the gear reducer 2 may be eliminated from the oscillator 10. Furthermore, the noncircular gears 2*b* can be incorporated in oscillators other than the short lever oscillator. Additionally, it is possible to employ noncircular gear arrangements different from that illustrated.

We claim:

1. An arrangement for oscillating a mold back-and-forth along a predetermined direction during continuous casting of a strand which is formed in the mold and is withdrawn from the latter in the predetermined direction at a predetermined speed, said arrangement comprising drive means; and means for linking said drive means to the mold, said linking means including noncircular gear means for moving the mold in excess of the predetermined speed during the major part of the displacement of the mold concurrently with the strand.

2. The arrangement of claim 1, wherein said linking means further comprises a reducer.

3. The arrangement of claim 1, wherein said linking means further comprises a two-armed lever having a first arm for connection to the mold and a second arm for connection to said gear means.

4. The arrangement of claim 3, wherein said linking means further comprises an eccentric between said gear means and said second arm.

5. The arrangement of claim 1, wherein said gear means comprises a pair of meshing, noncircular gears.

6. The arrangement of claim 1, wherein said gear means is designed to move the mold at a relatively constant speed during the major part of the displacement of the mold concurrently with the strand.

7. The arrangement of claim 1, wherein said drive means comprises an electrical motor.

* * * * *